US011885504B2

(12) United States Patent
Diaz Benito et al.

(10) Patent No.: US 11,885,504 B2
(45) Date of Patent: Jan. 30, 2024

(54) COOKING DEVICE WITH A SPECIFICALLY DESIGNED CATALYST DEVICE, AND METHOD FOR PRODUCING A COOKING DEVICE

(71) Applicant: BSH Hausgeräte GmbH, Munich (DE)

(72) Inventors: Belen Diaz Benito, Waging am See (DE); Gerhard Schmidmayer, Bad Endorf (DE)

(73) Assignee: BSH Hausgeräte GmbH, Munich (DE)

( * ) Notice: Subject to any disclaimer, the term of this patent is extended or adjusted under 35 U.S.C. 154(b) by 497 days.

(21) Appl. No.: 16/772,220

(22) PCT Filed: Nov. 23, 2018

(86) PCT No.: PCT/EP2018/082324

§ 371 (c)(1),
(2) Date: Jun. 12, 2020

(87) PCT Pub. No.: WO2019/120874

PCT Pub. Date: Jun. 27, 2019

(65) Prior Publication Data

US 2021/0071877 A1 Mar. 11, 2021

(30) Foreign Application Priority Data

Dec. 18, 2017 (DE) ..... 10 2017 223 090.8

(51) Int. Cl.
*F24C 15/20* (2006.01)

(52) U.S. Cl.
CPC ..... *F24C 15/2014* (2013.01)

(58) Field of Classification Search
CPC ..... F24C 15/2014
See application file for complete search history.

(56) References Cited

U.S. PATENT DOCUMENTS 5,063,029 A 11/1991 Abe
5,200,154 A 4/1993 Abe
5,996,338 A 12/1999 Hirota
(Continued)

FOREIGN PATENT DOCUMENTS

CN 105163407 B * 4/2018
DE 4139904 A1 6/1993
(Continued)

OTHER PUBLICATIONS

English abstract of Wang reference.*
(Continued)

*Primary Examiner* — Jason Lau
(74) *Attorney, Agent, or Firm* — Michael B. Tschupp; Andre Pallapies; Brandon G. Braun

(57) ABSTRACT

A cooking device includes a catalyst device having a base unit which is made of electrically conductive material and on which a plurality of catalytically active elements or a catalytically active surface coating is arranged. The base unit has electric connection regions which are at least partly made of a pressed material region of the base unit and/or at least partly have an electrically conductive adhesive. An electric energy unit is connected to the electric connection regions of the base unit and supplies the base unit with electric energy for a self-heating of the catalyst device.

18 Claims, 2 Drawing Sheets

(56) References Cited

U.S. PATENT DOCUMENTS

| | | | | |
|---|---|---|---|---|
| 2010/0326290 | A1 | 12/2010 | Gallici | |
| 2013/0270258 | A1 | 10/2013 | Hosoi | |
| 2014/0225603 | A1 * | 8/2014 | Auguste | G01R 21/133 324/244 |

FOREIGN PATENT DOCUMENTS

| | | | | |
|---|---|---|---|---|
| DE | 19608512 | A1 | 9/1997 | |
| EP | 1790910 | A2 | 5/2007 | |
| EP | 2657615 | A1 | 10/2013 | |
| JP | 2009243383 | A * | 10/2009 | B01D 53/9454 |

OTHER PUBLICATIONS

National Search Report DE 10 2017 223 090.8 dated Feb. 28, 2018.
International Search Report PCT/EP2018/082324 dated Feb. 15, 2019.

* cited by examiner

COOKING DEVICE WITH A SPECIFICALLY DESIGNED CATALYST DEVICE, AND METHOD FOR PRODUCING A COOKING DEVICE

CROSS-REFERENCES TO RELATED APPLICATIONS

This application is the U.S. National Stage of International Application No. PCT/EP2018/082324, filed Nov. 23, 2018, which designated the United States and has been published as International Publication No. WO 2019/120874 A1 and which claims the priority of German Patent Application, Serial No. 10 2017 223 090.8, filed Dec. 18, 2017, pursuant to 35 U.S.C. 119(a)-(d).

BACKGROUND OF THE INVENTION

The invention relates to a cooking device comprising a catalyst device that has a base unit, which is made of an electrically conductive material. A plurality of catalytically active elements or a catalytically active surface coating is arranged on this material. The cooking device also comprises an electric energy unit, by means of which the base unit can be supplied with electric energy for a self-heating process of the catalyst device. The base unit has electric connection regions for connecting the electric energy unit. Moreover, the invention further relates to a method for producing a cooking device.

In cooking devices which have a cooking chamber which is defined, on the one hand, by walls, for example a muffle, and which is also able to be closed by a door of the cooking device, fumes and/or odors are present during operation and thus when preparing food. These fumes and/or odors are present in the cooking chamber due to the process of preparing food and are discharged from the cooking chamber. The same may also be provided in a cooking device which has a pyrolysis mode, wherein corresponding odors may also be present in such a pyrolysis mode. Since these odors are also conducted out of the cooking device as exhaust gases which are denoted as vapor streams, therefore, they also correspondingly pass into the surroundings of the cooking device and thus into the kitchen areas or living areas.

In order to reduce this odor formation of the vapor streams escaping from the cooking device, it is known that catalyst devices are used in a cooking device. This is disclosed, for example, in EP 1790910 A2 and EP 2093490 A1.

In the disclosed embodiments, however, the self-heating process is restricted since the possibilities for connecting the electric energy unit are limited so that it may also arise that the transmission of electric energy is only possible to a limited extent.

BRIEF SUMMARY OF THE INVENTION

It is the object of the present invention to provide a cooking device and a method in which the supply of electric energy to a catalyst device of the cooking device is improved.

This object is achieved by a cooking device and a method as claimed in the independent claims.

One feature of the invention relates to a cooking device comprising a catalyst device. The catalyst device has a base unit, which is made of an electrically conductive material. A plurality of catalytically active elements or a catalytically active surface coating is applied to this electrically conductive material, wherein the catalytically active elements or the surface coating are also components of the catalyst device. The cooking device also comprises an electric energy unit, by means of which the base unit can be supplied with electric energy for a self-heating process of the catalyst device. The base unit of the catalyst device has electric connection regions for connecting the electric energy unit. These electric connection regions are at least partly made of a pressed material region of the base unit and/or at least partly made of a partial region of the base unit, an electrically conductive adhesive being additionally configured in the material thereof. By means of such an embodiment, specific zones of this base unit are improved, namely specifically those regions to which the electric energy unit is physically attached. On the one hand, these regions are designed to be more mechanically stable and, on the other hand, the general connectivity is improved thereby. In particular, by means of these embodiments with a pressed material region and/or a region which is impregnated with electrically conductive adhesive, in addition to the material region of the base unit, it is possible to transmit the electric energy from the electric energy unit to the base unit in an improved manner. Thus a more energy-efficient operation of the catalyst device is permitted thereby and losses of electric energy are reduced. In particular, therefore, the proportion of electric energy produced may then be transmitted more extensively and directly to the base unit, so that optionally the electric energy unit may also have smaller dimensions. Thus, since the transmission of electric energy to the base unit is improved by these specifically designed connection regions, a more efficient self-heating process is also possible.

Specifically in the embodiment in which the material of the base unit itself is locally compressed, therefore, it is no longer necessary to design the base unit from a wide variety of different materials. As a result, economies may be made relative to the production cost and the complexity of the base unit may be reduced. Thus, in this embodiment the base unit may be advantageously made of a single electrically conductive material which thus has a density which is locally and individually variable, and a greater material density is produced in a defined manner specifically at the points which form the connection regions.

An advantage is also provided in the alternative embodiment, as has been mentioned above, since in this case the base unit may also be provided from a material which is advantageously electrically conductive and which no longer has to be treated, therefore, in terms of this material being produced with an individual density, but this material may be supplemented at specific local points with a specifically defined different material, namely the electrically conductive adhesive. This also results in a greater material density in comparison with the remaining region of the base unit and, therefore, a greater solidity of these regions, such that in this case a greater mechanical stability and, in particular, a significantly improved transmission of electric energy are also possible in a particularly defined manner.

In an advantageous embodiment it is provided that the base unit is configured from a foam body. The electrically conductive material, therefore, is advantageously a porous foam body. By means of such an embodiment, the weight is significantly reduced and the catalytic action substantially improved by the foam body which thus also has a significantly larger surface area than a solid body. Specifically in such an embodiment, therefore, the individual treatment of regions may be particularly advantageously achieved so that in this case the pressed material regions may also be produced in a particularly defined and compact manner. Thus in an alternative embodiment it is also very advantageous to introduce, to a sufficient degree and extensively, electrically conductive adhesive which then may be extensively distributed in the cells of this porous structure of the foam body and which also remains in place.

This porous foam body is thus effectively impregnated with the adhesive and/or this adhesive also extensively penetrates the porous structure of the foam body.

Preferably, it is provided that the foam body is pressed into the electric connection regions and has a greater density than in the remaining region of the base unit.

In particular, it is provided that the foam body is impregnated with the adhesive in the electric connection regions and the adhesive is also applied to the surfaces of the foam body. Thus, as a result, the electrical contact is also possible in a particularly advantageous manner and an exceptionally extensive transmission of the electric energy with particularly low losses is possible.

Preferably, it is provided that in each case the electric connection regions have a solid contact plate made of an electrically conductive material. Thus this contact plate is configured, in particular, without porousness and thus without porosity. This embodiment with the solid contact plate may be present in addition to the exemplary embodiments mentioned in the introduction. However, in a further exemplary embodiment it may also be provided that only these solid contact plates are present.

Preferably, it is provided that such a contact plate is, in particular, welded or soldered onto the base unit, in particular onto a foam body of the base unit, in a non-destructive and unreleasable manner. Thus the aforementioned advantages may also be achieved thereby and a base unit which is very robust and advantageous in terms of the self-heating process is provided.

Preferably, it is provided that the base unit is configured from metal.

In an advantageous embodiment it is provided that this metal is an alloy. By means of an alloy it is possible to fulfil the respective requirements in a particularly advantageous manner, in particular an extensive absorption of the transmitted electric energy and very rapid heating up, even to relatively high temperatures, are possible. Moreover, alloys are relatively robust and low in terms of wear, so that the functionality of the catalyst device is also permanently high.

In an advantageous embodiment the metal comprises nickel. Nickel is particularly advantageous relative to the aforementioned advantages.

If the metal is an alloy, preferably the material may be NiCr and/or NiCrFe and/or NiFeCrAl and/or NiCrAl, etc. This specific designation, however, is not to be understood as definitive and other metals may be provided, in particular such metals which have a high resistance. Preferably, materials may be used which may be heated up to a temperature of at least 250° C. The catalytic reaction is an exothermic reaction in which temperatures of above 250° C. and in some cases even temperatures of above 500° C. may be reached. Such high temperatures are reached specifically during pyrolysis mode, so that the material of the base unit also has to withstand these temperatures easily and permanently. The materials from which the base unit is configured should also have a high electric resistance. Moreover, the materials should have a corresponding high thermal capacity, in order to be able to be heated on the basis of the Joule effect. The materials should preferably also have a high thermal conductivity in order to be able to be heated very rapidly.

In advantageous embodiments, the material of the base unit is configured with a correspondingly high porosity. Flexibility should also be present in an advantageous embodiment in which this material has different pore sizes. A large surface area which, in particular, is provided by the corresponding porosity should also be present. By means of a surface area which is as large as possible, the contact between the catalytically active elements and/or the surface coating and the vapor stream from the cooking chamber is particularly effective, so that the catalytic effect may be present in a particularly advantageous manner. Moreover, by means of such an open cell structure which is provided by the porosity, a turbulent airflow and/or vapor stream is also produced in the catalyst device, whereby contact is permitted between the catalytically active elements and/or the corresponding surface coating and the vapor stream, in particular the molecules which produce the contamination and/or odor formation.

Preferably, the catalyst device is configured as a flat cylinder. As a result, said catalyst device may be inserted particularly advantageously into a channel of an exhaust air guiding system of the cooking device and fill up said channel, preferably the entire flow cross section thereof. A particularly advantageous catalytic effect is achieved thereby.

Preferably, the cooking device has an exhaust air channel, by means of which an exhaust airflow and/or a vapor stream produced during operation of the cooking device in the cooking chamber is able to be discharged from the cooking device, wherein the catalyst device is arranged in the exhaust air channel.

By means of this embodiment of the catalyst device having the base unit which is made of an electrically conductive material, the direct heating of this catalyst unit may be carried out via electric energy. As a result, the mode of operation of the catalyst device is significantly improved and may be individually customized in a defined manner in terms of the catalytic effect. This has substantial advantages in comparison with catalyst devices which are not directly heated via an electric energy unit and thus are not heated via an electric energy supply but, for example, via a hot exhaust airflow which is produced in the cooking device itself.

By means of the aforementioned embodiment of the catalyst device, in addition to the advantages already mentioned above, an improved temperature distribution may also be achieved in the catalyst device so that, in particular, a more uniform temperature distribution is also present. When the catalytic reaction is initiated, heat is produced by the catalyst device itself, in particular due to the exothermic reaction. Due to this fact, therefore, the electric energy supply may be further reduced or even entirely discontinued. This method is based on the Joule effect.

In an advantageous embodiment, the base unit is thinner at the connection regions, in particular when the material region is pressed at that point, in comparison with those material regions in which the base unit is configured otherwise and which do not constitute connection regions for the electric energy unit. In particular, it is provided that a material region which is pressed in such a manner is configured on the edge side so that, in a cross-sectional view of the base unit, a relative thinning is formed on the edge side. In an embodiment in which the base unit is configured with a base material, in particular a porous foam body, made of a metal material and in which additionally the electrically conductive adhesive is then optionally introduced, such a thinning may also be configured on the edge side, however in such an embodiment it is possible for the thickness of the base unit at these electric connection regions, therefore, to be equal to the thickness of the base unit outside the electric connection regions.

A further feature of the invention relates to a method for producing a cooking device, in which the cooking device is configured with a catalyst device which has a base unit which is made of an electrically conductive material, and on which a plurality of catalytically active elements or a catalytically active surface coating of the catalyst device is arranged. The cooking device is also configured with an electric energy unit, by means of which the base unit can be supplied with electric energy for a self-heating process of the catalyst device, wherein the base unit is configured with electric connection regions for connecting the electric energy unit. The electric connection regions are at least partly made by pressing material regions of the base unit and/or an electrically conductive adhesive is at least partly applied to the base unit in order to produce the connection regions in a defined manner.

The advantages which may be achieved in this regard have already been mentioned above relative to the cooking device.

Advantageous embodiments of the cooking device are to be regarded as advantageous embodiments of the method, wherein the respective physical components of the cooking device are thus correspondingly installed during production in order to produce also the corresponding effect in the cooking device.

The positions and orientations which are provided when using the device in the intended manner and when arranging the device in the intended manner are specified by the terms "above, "below", "front", "rear", "horizontal", "vertical", "depth direction", "width direction", "vertical direction".

Further features of the invention are disclosed in the claims, the figures and the description of the figures. The features and combinations of features mentioned above in the description and the features and combinations of features mentioned hereinafter in the description of the figures and/or shown individually in the figures are not only able to be used in the respectively specified combination but also in other combinations or individually, without departing from the scope of the invention. Embodiments which are not explicitly shown and described in the figures but which emerge and are able to be generated from separate combinations of features from the described embodiments are, therefore, to be regarded as encompassed and disclosed by the invention. Embodiments and combinations of features which thus do not have all of the features of an originally formulated independent claim are also to be regarded as disclosed.

BRIEF DESCRIPTION OF THE DRAWINGS

Exemplary embodiments of the invention are described in more detail hereinafter with reference to schematic drawings. In the drawings.

DETAILED DESCRIPTION OF EXEMPLARY EMBODIMENTS OF THE PRESENT INVENTION

Figure 1:
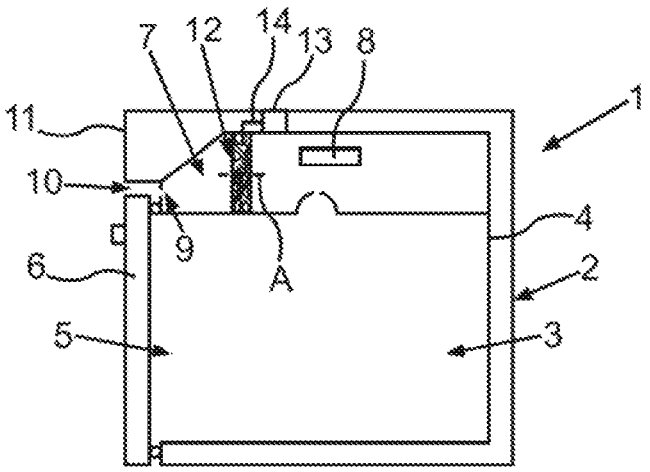
FIG. 1 shows a schematic vertical sectional view of an exemplary embodiment of a cooking device according to the invention.

Elements which are the same or functionally the same are provided with the same reference numerals in the figures.

A cooking device 1 which, for example, may be an oven or a microwave cooking device or a steam cooking device is shown in FIG. 1 in a vertical sectional view (the cutting plane is the vertical direction and the depth direction). The cooking device 1 may also have some of these aforementioned functionalities in common and/or may have a pyrolytic function. The cooking device 1 which is thus configured for preparing food has a housing 2 in which a cooking chamber 3 is configured. Food may be introduced and prepared in the cooking chamber 3. The cooking chamber 3 is delimited by walls of a muffle 4 which is supported in the housing 2. On the front face and thus in the depth direction (z-direction) at the front the muffle 4 has a loading opening 5, access to the supporting space and/or cooking chamber 3 being permitted thereby. The cooking device 1 also has a door 6 which is pivotably arranged on the housing 2 and which is provided for closing the cooking chamber 3. In FIG. 1 the closed state is shown relative thereto.

The cooking device 1 also has an exhaust air channel 7 via which vapor streams, which are produced during operation of the cooking device 1 and which are present in the cooking chamber 3, may be dissipated and/or conducted away from the cooking chamber 3 and also from the cooking device 1. In particular, it is provided that a fan 8 is arranged in the exhaust air channel 7 which may be a component of an air guiding system, said fan being able to suction and transport the vapor stream out of the supporting space and/or the cooking chamber 3. In the exemplary embodiment it is provided that the exhaust air channel 7 on the front face, in particular on a side facing the door 6, has an outlet opening 9, so that an airflow may be blown out via this outlet opening 9 to the front, in particular through a gap 10. The gap 10 is preferably configured between the door 6 and the housing 2, in particular a control panel 11.

The cooking device 1 also has a catalyst device 12, a catalytic conversion of the vapor stream being able to be carried out thereby. As a result, in particular, it is also achieved that undesired odors may escape from the cooking device 1 and thus effectively a cleaning of this vapor stream is also carried out by the catalyst device 12 so that the airflow, which flows downstream of the catalyst device 12 and flows out of the outlet opening 9 and then out of the cooking device 1, is reduced in terms of odor and/or is neutral in terms of odor relative thereto.

The cooking device 1 also has an electric energy unit 13 which is separate from the catalyst device 12. The electric energy unit 13 is electrically connected to the catalyst device 12, in particular via cables 14. The catalyst device 12 may be directly heated by the supply of electric energy to the catalyst device 12 by the electric energy unit 13. As may be identified here, the catalyst device 12, in particular, is configured over the entire cross section of the exhaust air channel 7.

Figure 2:
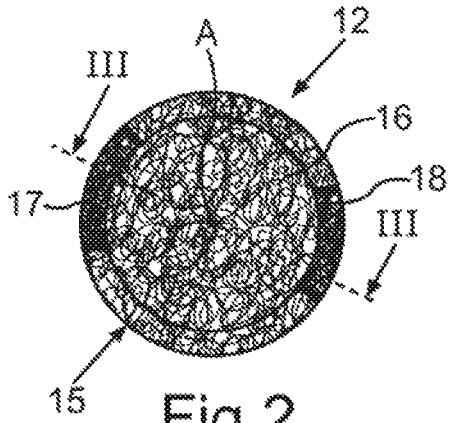
FIG. 2 shows a view of an exemplary embodiment of a catalyst device as installed in the cooking device according to FIG. 1.

In FIG. 2 an exemplary embodiment of a catalyst device 12 is shown in a schematic plan view. The catalyst device 12 has a base unit 15 which is advantageously formed in this case by a porous foam body made of a metal foam. A plurality of catalytically active elements 16 or a catalytically active surface coating is applied to this base unit 15.

Moreover, the base unit 15, which is configured cylindrically in this case, has electric connection regions 17 and 18 configured on the edge side. The electric energy unit 13 is electrically connected, in particular via the cables 14, to these electric connection regions 17 and 18. Both the position and the dimensions of the electric connection regions 17 and 18 are to be understood merely by way of example.

Preferably, it is provided that in the exemplary embodiment shown here the electric connection regions 17 and 18 are made of the same material as the remaining embodiment of the base unit 15. This means that the electric connection regions 17 and 18 are also formed in this case from a porous foam body made of metal. However, in this exemplary embodiment it is provided that these electric connection regions 17 and 18 are pressed so that in this case a pressed material region of the porous foam body is present which in this case has a greater density than in the regions of the base unit 15 outside these electric connection regions 17 and 18.

Figure 3:
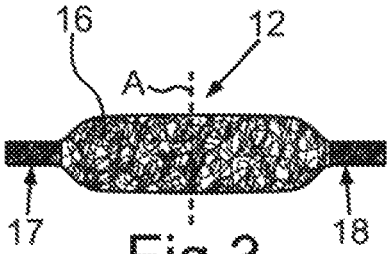
FIG. 3 shows a sectional view through the catalyst unit according to FIG. 2.

In FIG. 3 the catalyst device 12 is shown along the cutting line III-III in FIG. 2. Viewed in the direction of the longitudinal axis A of the catalyst device 12, the dimensions of the electric connection regions 17 and 18 which are formed by the pressed material regions are thinner here than the remaining region of the base unit 15.

Figure 4:
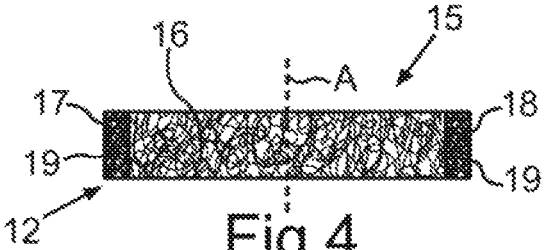
FIG. 4 shows a sectional view corresponding to FIG. 3 with an embodiment of a catalyst device which is different from FIG. 2 and FIG. 3.

In FIG. 4 a further exemplary embodiment of a catalyst device 12 is shown in a schematic sectional view. In this embodiment in contrast to FIG. 3 it is provided that the electric connection regions 17 and 18 have an axial thickness which corresponds to the thickness of the remaining region of the base unit 15. In this embodiment it is provided that, in principle, the electric connection regions 17 and 18 are also formed by the porous foam body made of metal, which is also configured outside the electric connection regions 17 and 18 in the base unit 15, wherein in this case these material regions are not pressed or are pressed such that they still have a lower density than in the exemplary embodiment according to FIG. 2 and FIG. 3. Moreover, in this case it is provided that an electrically conductive adhesive 19 is introduced for defining the boundary zones of the electric connection regions 17 and 18 so that in this case the porous foam body is effectively impregnated with this electrically conductive adhesive 19. Thus electric connection regions 17 and 18 are formed thereby. In this exemplary embodiment with the electrically conductive adhesive 19 it may also be provided that the defined electric connection regions 17 and 18 in the axial direction are thinner than the remaining region of the base unit 15, i.e. at least slightly pressed.

Figure 5:
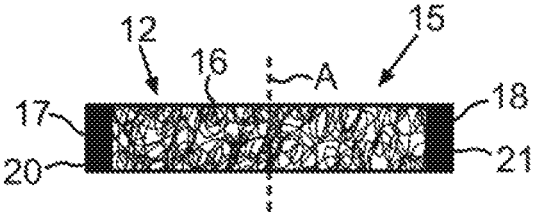
FIG. 5 shows a view according to FIG. 3 and FIG. 4 with a catalyst device which is different again relative thereto.

Moreover, in FIG. 5 a further exemplary embodiment of a catalyst device 12 is shown in another schematic view. In this embodiment it is provided that the electric connection regions 17 and 18 are formed by contact plates 20 and 21 which are solid and thus effectively without pores. In particular, optionally the contact plates may even be additionally provided as a supplement to the exemplary embodiments three and four. These contact plates 20, 21 are, in particular, welded to the foam body.

The invention claimed is:

1. A cooking device, comprising:

a catalyst device having a base unit which is made of electrically conductive material and on which a plurality of catalytically active elements or a catalytically active surface coating is arranged, said base unit having electric connection regions which each comprise a compressed region of the electrically conductive material of the base unit, the electric connection regions having a thickness that is thinner than a thickness of the base unit at regions that are not the connection regions, wherein the electric connection regions of the base unit are configured to be connected to electric energy to supply the base unit with electric energy for a self-heating of the catalyst device, wherein the thickness of the electric connection regions is a total thickness of the base unit at the electrical connection regions.

2. The cooking device of claim 1, wherein the base unit is configured from a porous foam body.

3. The cooking device of claim 2, wherein the foam body is compressed into the electric connection regions, and the electric connection regions have a density which is greater than a density in the regions of the base unit that are not the connection regions.

4. A cooking device, comprising:

a catalyst device having a base unit which is made of electrically conductive material and on which a plurality of catalytically active elements or a catalytically active surface coating is arranged, said base unit having a porous structure and having electric connection regions which each comprise an electrically conductive adhesive located in pores of the porous structure of the base unit, wherein the electric connection regions of the base unit are configured to be connected to electric energy to supply the base unit with electric energy for a self-heating of the catalyst device, wherein the porous structure of the base unit is impregnated with the adhesive in the electric connection regions, with the adhesive being applied at least to a surface of the foam body, wherein the electric connection regions are configured to be connected to the electric energy at outer surfaces of the electric connection regions, the outer surfaces being formed by the base unit and the adhesive, and wherein the thickness of the electric connection regions is a total thickness of the base unit at the electrical connection regions.

5. The cooking device of claim 1, wherein the electric connection regions have each a solid contact plate made of electrically conductive material.

6. The cooking device of claim 5, wherein the contact plate is welded or soldered onto the base unit.

7. The cooking device of claim 5, wherein the contact plate is welded or soldered onto a foam body of the base unit.

8. The cooking device of claim 1, wherein the base unit is configured from metal. alloy.

9. The cooking device of claim 8, wherein the metal is an alloy.

10. The cooking device of claim 8, wherein the metal comprises nickel.

11. The cooking device of claim 1, wherein the catalyst device is configured as a flat cylinder.

12. The cooking device of claim 1, further comprising an exhaust air channel for discharge of an exhaust airflow produced during operation of the cooking device in a cooking chamber from the cooking device, said catalyst device being arranged in the exhaust air channel.

13. A method for producing a cooking device, said method comprising:

forming electric connection regions on a porous base unit of electrically conductive material by compressing regions of the base unit;

arranging a plurality of catalytically active elements or a catalytically active surface coating on the base unit to form a catalyst device;

connecting an electric energy unit to the electric connection regions of the base unit; and supplying the base unit with electric energy for a self-heating process of the catalyst device, wherein the electric connection regions are formed to have a thickness that is thinner than a thickness of the base unit at regions that are not the connection regions.

14. The method of claim 13, wherein the base unit is compressed to form the electric connection regions so that the electric connection regions have a density which is greater than a density in the regions of the base unit that are not the electrical connection regions.

15. The cooking device of claim 4, wherein the base unit is configured from metal.

16. The cooking device of claim 15, wherein the metal is an alloy.

17. The cooking device of claim 15, wherein the metal comprises nickel.

18. The cooking device of claim 4, wherein the catalyst device is configured as a flat cylinder.

* * * * *